US011576434B2

(12) United States Patent
Kerry et al.

(10) Patent No.: US 11,576,434 B2
(45) Date of Patent: Feb. 14, 2023

(54) DISPOSABLE CARTRIDGE CONSUMPTION SYSTEM

(71) Applicant: Huron Botanicals, LLC, Commerce Township, MI (US)

(72) Inventors: Paul J. Kerry, Burtchville, MI (US); Brad J. Maurer, Clawson, MI (US)

(73) Assignee: HURON BOTANICALS, LLC, Burtchville, MI (US)

( * ) Notice: Subject to any disclaimer, the term of this patent is extended or adjusted under 35 U.S.C. 154(b) by 165 days.

(21) Appl. No.: 16/875,969

(22) Filed: May 15, 2020

(65) Prior Publication Data

US 2020/0404965 A1 Dec. 31, 2020

Related U.S. Application Data

(60) Provisional application No. 62/848,108, filed on May 15, 2019.

(51) Int. Cl.

| | |
|---|---|
| ***A24F 40/42*** | (2020.01) |
| ***A24F 40/485*** | (2020.01) |
| ***A24F 40/10*** | (2020.01) |
| ***A24F 40/46*** | (2020.01) |

(52) U.S. Cl.

CPC ..... *A24F 40/42* (2020.01); *A24F 40/10* (2020.01); *A24F 40/46* (2020.01); *A24F 40/485* (2020.01)

(58) Field of Classification Search

CPC ..... A24F 40/70; A24F 40/485; A24F 40/10; A24F 40/42

See application file for complete search history.

(56) References Cited

U.S. PATENT DOCUMENTS

| | | | | |
|---|---|---|---|---|
| 2013/0213419 | A1 | 8/2013 | Tucker et al. | |
| 2016/0206003 | A1 | 7/2016 | Yamada et al. | |
| 2017/0290370 | A1* | 10/2017 | Garthaffner | A61M 11/042 |
| 2018/0289058 | A1 | 10/2018 | Chen | |

OTHER PUBLICATIONS

PCT search report and written opinion.

* cited by examiner

*Primary Examiner* — Jean F Duverne

(74) *Attorney, Agent, or Firm* — L.C. Begin & Assoc., PLLC

(57) ABSTRACT

A cartridge consumption system contains a first housing having a first open end and a second end, wherein the housing is adapted to contain a consumable material therein. The first open end is adapted to draw effluent from said housing therethrough, by a mouthpiece, for example. A heating element extends within the housing along the length of the housing from the second end towards the first end, the heating element adapted to directly contact and heat consumable material in thermal communication therewith. A power source such as a battery electrically communicates with the heating element, wherein the heating element is preferably a metallic mesh substrate.

19 Claims, 6 Drawing Sheets

DISPOSABLE CARTRIDGE CONSUMPTION SYSTEM

CROSS-REFERENCE TO RELATED APPLICATIONS

The present application claims the benefit of U.S. Provisional Patent Application No. 62/848,108 having a filing date of May 15, 2019.

BACKGROUND

Various vape cartridges have been designed and manufactured to provide an instrument for vaporizing and/or volatilizing various extracts, derivatives, or raw materials from different agricultural products such as derived from a variety of tobacco, cannabis, and/or hemp plants, for example. Consumable materials such as extracts, plant solids, oils, and liquids, in a thixotropic, solid, and/or liquid state are commercially available and may be consumed when loaded in a known way into the various commercially available vaporization (vape) cartridge systems. For example, U.S. Pat. Nos. 10,244,793, 10,617,150, and 10,159,282, all herein incorporated by reference as if fully stated, exemplify various vape cartridges that constitute various known designs. FIGS. 1 and 3 illustrate typical vape cartridges that provide an ambient heat, but not direct heating of a consumable material, within the cartridge housing.

One of the challenges typically found in many of the vape cartridge systems is the inability to fully utilize the extract because of the propensity of the extract to crystallize within the cartridge in the presence of heat. For a time, the crystallized extract may be re-melted within the cartridge while being operated by the user. However, oftentimes, the crystallization of the extract within known vape cartridge systems prevents the full or substantially complete consumption of the extract because eventually the heat provided by the cartridge system is simply not sufficient to melt the crystallized extract. As such, users of current state-of-the-art vape cartridges must oftentimes conduct remedial measures, such as heating within an oven, in order to melt the crystallized extract for subsequent full consumption within the cartridge.

SUMMARY OF THE PRESENT INVENTION

The above-referenced concerns are resolved by a novel cartridge consumption system containing a cartridge or tubular housing containing an innovative heating element. The term "consumption" refers to various ways to produce effluent from the cartridge such as volatilization, vaporization, and/or combustion depending on the consumable material that is loaded within the cartridge for consumption thereof.

In a first embodiment, a cartridge consumption system contains a cartridge containing a first housing having a first open end and a second end, wherein the cartridge is adapted to contain a consumable material therein. The first open end is adapted to draw effluent from said housing therethrough, by a mouthpiece for example. A heating element extends within the housing along the length of the housing from the second end towards the first end, the heating element adapted to directly contact and heat consumable material in thermal communication therewith. A power source such as a battery may be in electronic communication with the heating element, wherein the heating element is preferably a metallic mesh substrate.

In another exemplary embodiment, a cartridge consumption system contains a cartridge or tubular housing having a first open end, a second end, and an annular wall, the first open end adapted to draw air and tubular effluent therefrom. A metallic mesh heating element extends within and along the length of the tubular housing, and electronically communicates with a power source, for directly heating a thixotropic, solid, and/or liquid consumable material in direct contact therewith. The power source such as a battery is remotely connected to the housing for heating the metallic mesh heating element contained within the housing, and for also heating the annular wall of the cartridge housing. The metallic mesh heating element may be a folded, crimped metal mesh substrate, wherein the metallic mesh heating element may have a mid-portion with about half of a thickness of a first end portion and a second end portion of the metallic mesh heating element. The heat cup is insulated from the power source, wherein the first end portion thermally and/or electrically communicates with the power source, and, the second end portion thermally and/or electrically communicates with the heat cup.

A method for forming the metallic mesh heating element by folding and crimping the metallic mesh substrate is also provided, as is a cartridge consumption system containing a metallic mesh heating element formed thereby. These and other details are amplified in the following Detailed Description, and will become more apparent as detailed therein.

DETAILED DESCRIPTION OF THE INVENTION

Figure 1:
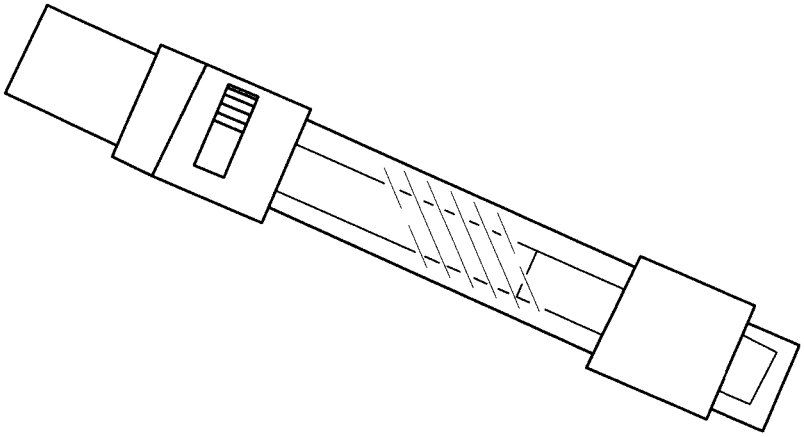
FIG - 1 Prior Art
FIG. 1 is a side view of a prior art embodiment of a vaporization cartridge.
Figure 2:
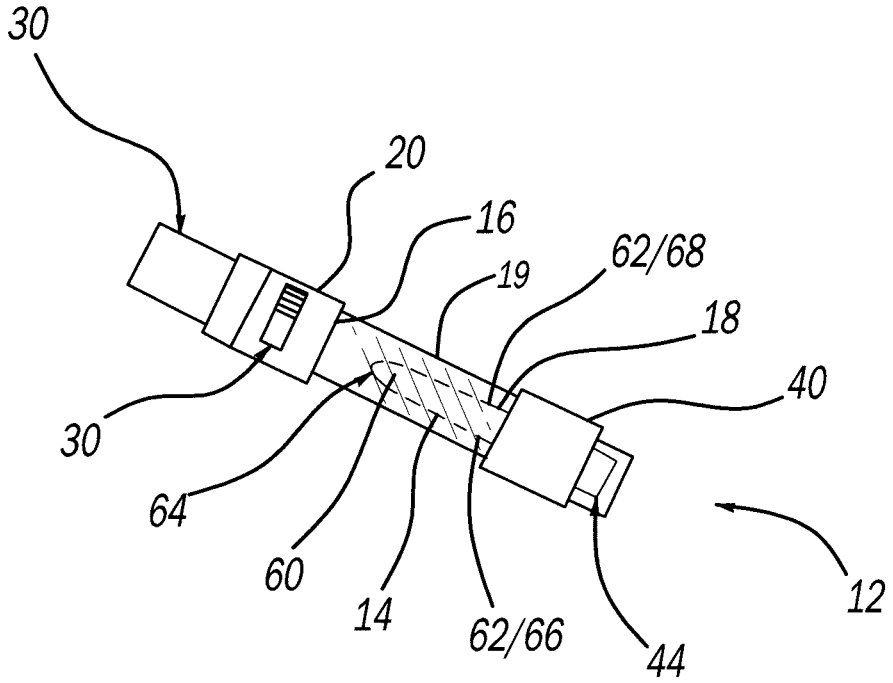
FIG. 2 is a side view of an exemplary consumption cartridge of the present invention.
Figure 3:
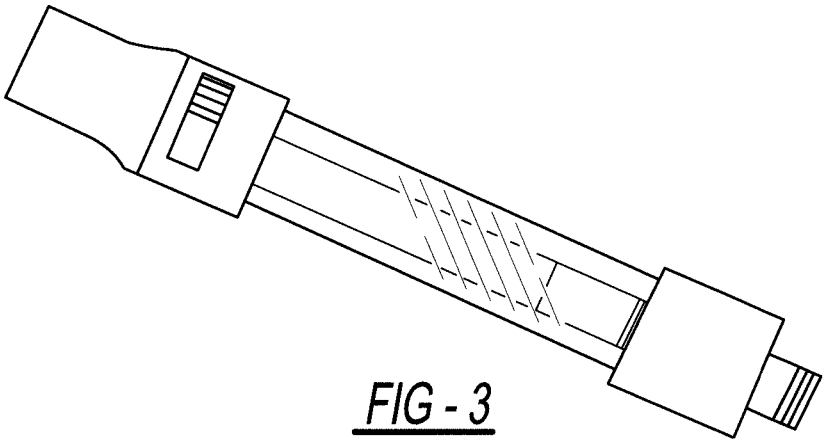
FIG - 3 Prior Art
FIG. 3 is a side view of a prior art embodiment of a vaporization cartridge.

With reference to the Figures, the present invention contains a cartridge consumption system 10 containing a disposable and/or reusable cartridge 12 for consumption of extracted products including waxy or crystallized materials known as "DAB", for example. See https://www.nuggmd.com/blog/how-to-dab-concentrated-cannabis, for a description of how the present cartridge consumption systems may be utilized. Alternatively, it will be appreciated that raw plant materials may also be consumed within the present cartridge consumption system 10. As such, although the present cartridge 12 may be used to "vape" or vaporize or volatilize the oils and/or extracts contained therein, in other embodiments, it may also be used to combust raw plant materials, for example, and more broadly, consume extracts, oils, liquids, solids, and raw plants. Accordingly, as shown in the Figures, a disposable cartridge 12 contains a housing 14 having a first end 16 and a second end 18, wherein the housing 14 is preferably formed from glass or some other suitable high temperature material, for storing and ultimately combusting raw materials such as waxy or crystallized plant extracts.

A perforated collar or annular cap 20 is press fit about or otherwise fixed to the first end 16. The collar 20 contains an inner longitudinal orifice 22 for passage and inhalation of combustion products therethrough. An upper collar rim 24 extends from the first end 16 and is integral to the collar 20. One or more collar orifices 26 radially extend through, and are laterally spaced about, a portion of the rim 24, and if desired, provide a draw of ambient air to cool the combustion products being drawn through the collar 20.

A mouthpiece 30 contains an annular passage way 28 for drawing combustion products from the housing 14, wherein the mouthpiece 30 is rotatably and slidably seated about an outer periphery of the rim 24. One or more mouthpiece apertures 32 radially extend through and are laterally formed about the mouthpiece 30, such that the apertures 32 overlay the collar rim 24. Accordingly, as the mouthpiece 30 is rotated, the collar orifices 26 may be opened or closed depending on whether or not the apertures 32 directly overlay the orifices 26 for an "open" position, or, whether the apertures 32 are rotated to a position wherein the collar orifices are occluded or "closed" by the mouthpiece 30. As such, a user of the cartridge or housing 12 may adjust the draw of outside air through the collar orifices 26 by rotatably adjusting the position of the apertures 32 to expose or occlude the collar orifices 26 to a greater or lesser extent. In accordance with the present invention, the collar orifices 26 may, if desired, be reduced or increased in size to thereby increase or reduce the desired operational draw of air through the orifices 26. Yet further, cuts 34 may be formed along a circumferential edge 36 of the mouthpiece 30, to thereby provide even further draw from the outside air, for cooling of the combustion or volatilized effluent, for example.

Figure 7:
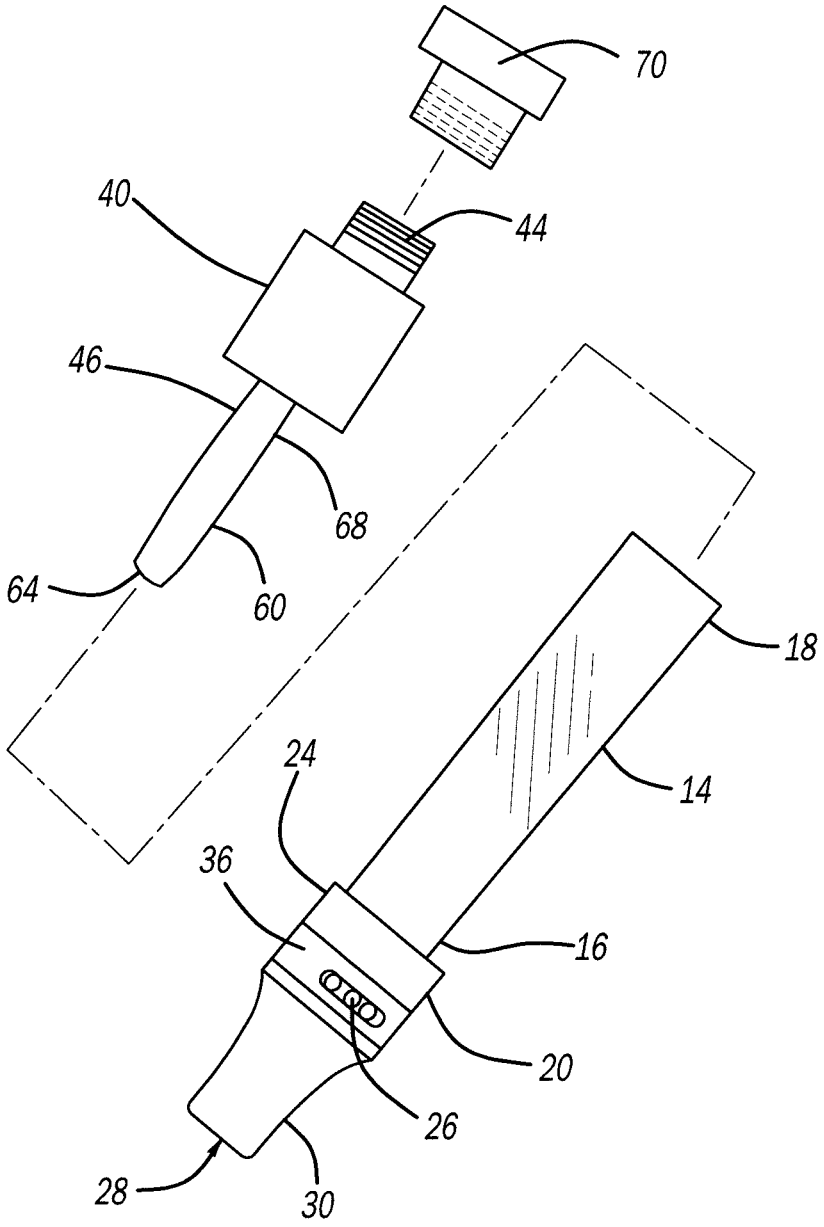
FIG. 7 is a side view of a first section and a second section of a consumption cartridge, in accordance with the present invention.

A base 40 is press fit or otherwise fixed about the periphery of the second housing end 18. An interior 42 defined by the hollow base 40 contains heating constituents of the cartridge 12, in accordance with the present invention. A threaded battery contact 44 is provided at a bottom end of the base 40, for threaded and electrical contact with a battery 70, as shown in FIG. 7. A heat element cup 46 is seated within the base 40, and during operation of the system 10, communicates with heat provided from an electric potential provided through the battery contact 44. An insulating annular seal 48, such as a high-temperature silicone seal, is snugly seated within the heat element cup 46, for controlling electrical current from a battery source 70. A battery-contact end piece 50 is seated within and extends to the threaded battery contact 44, for conducting electrical current through the battery contact 44 into the heat element cup 46.

In accordance with the present invention, a heat element 60 contains an open end 62 and a closed end 64, and electrically communicates with a battery 70 for heating thereof. A first prong or end portion 66, and a second prong or end portion 68 define the open end 62 and provide electrical communication between the battery contact 44 and battery-contact endpiece 50, and the heat element cup 46. More specifically, the first prong 66 is fixed or secured between an outer wall of the battery-contact endpiece 50 and an inner wall of the annular silicone seal 48 juxtaposed thereto. The second prong 68 is fixed or secured between an outer wall of the annular silicone seal 48 and an inner wall of the heat element cup 46. Accordingly, when a battery energizes the battery-contact endpiece 50 during operation of the cartridge 12, the heat element first prong 66 conducts electric potential from the battery across the heat element 60 and through the second prong 68. As the heat element 60 heats up, the heat element cup contacts the housing 14 to provide an enhanced heated environment within the housing 14.

The closed second end 64 of the heat element 60 extends up within the interior of the glass housing 14, and into the crusty and/or thixotropic consistency of the waxy or crystallized extract/raw product 17 that is loaded and contained therein. Accordingly, as the heat element 60 becomes fully heated, the combustion or vaporization efficiency of the consumable material 17 is optimized, substantially because of the enhanced heating in the present cartridge system 10. Yet further, as the glass housing 14 is heated by virtue of its contact with an outer wall of the heating cup 46, any raw material adhering to the inner annular wall 19 of the housing 14 is readily combusted or volatilized for ready evacuation through the mouthpiece 30.

Figure 4:
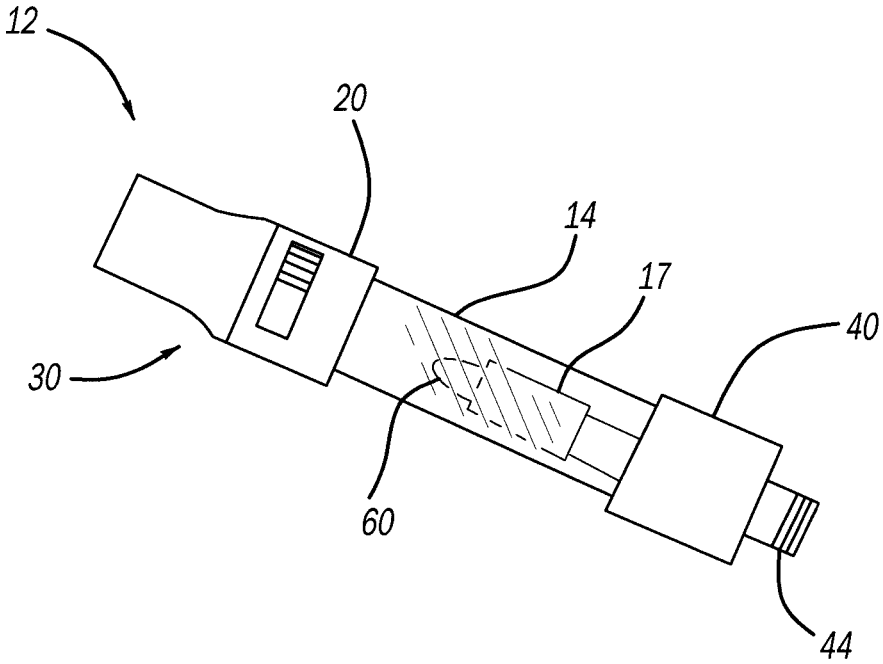
FIG. 4 is a side view of an exemplary consumption cartridge containing a heating element, in accordance with the present invention.
Figure 5:
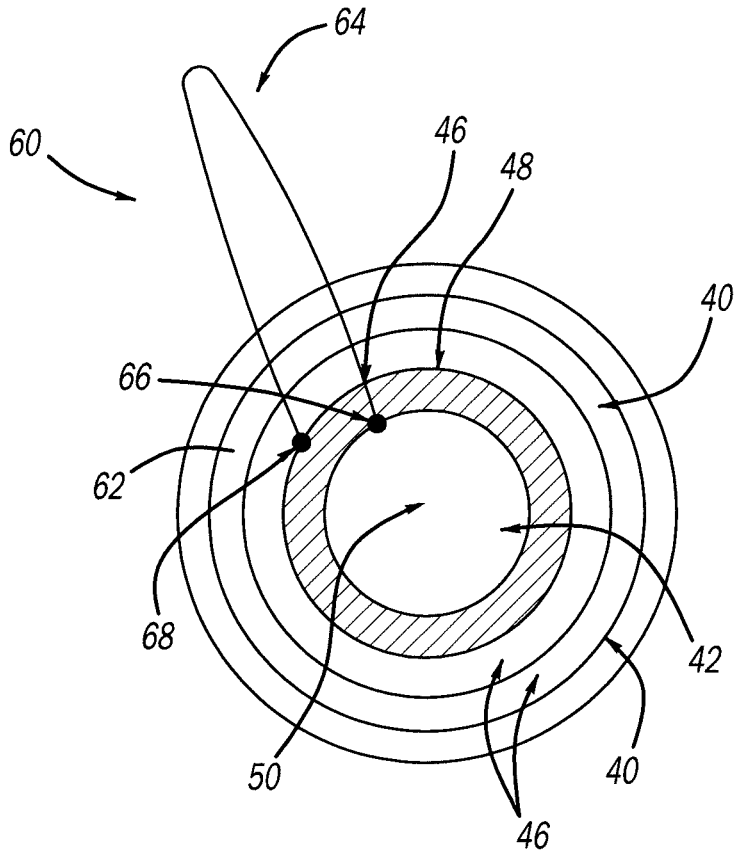
FIG. 5 is a cross-sectional view of a heating assembly in accordance with the present invention.
Figure 6:
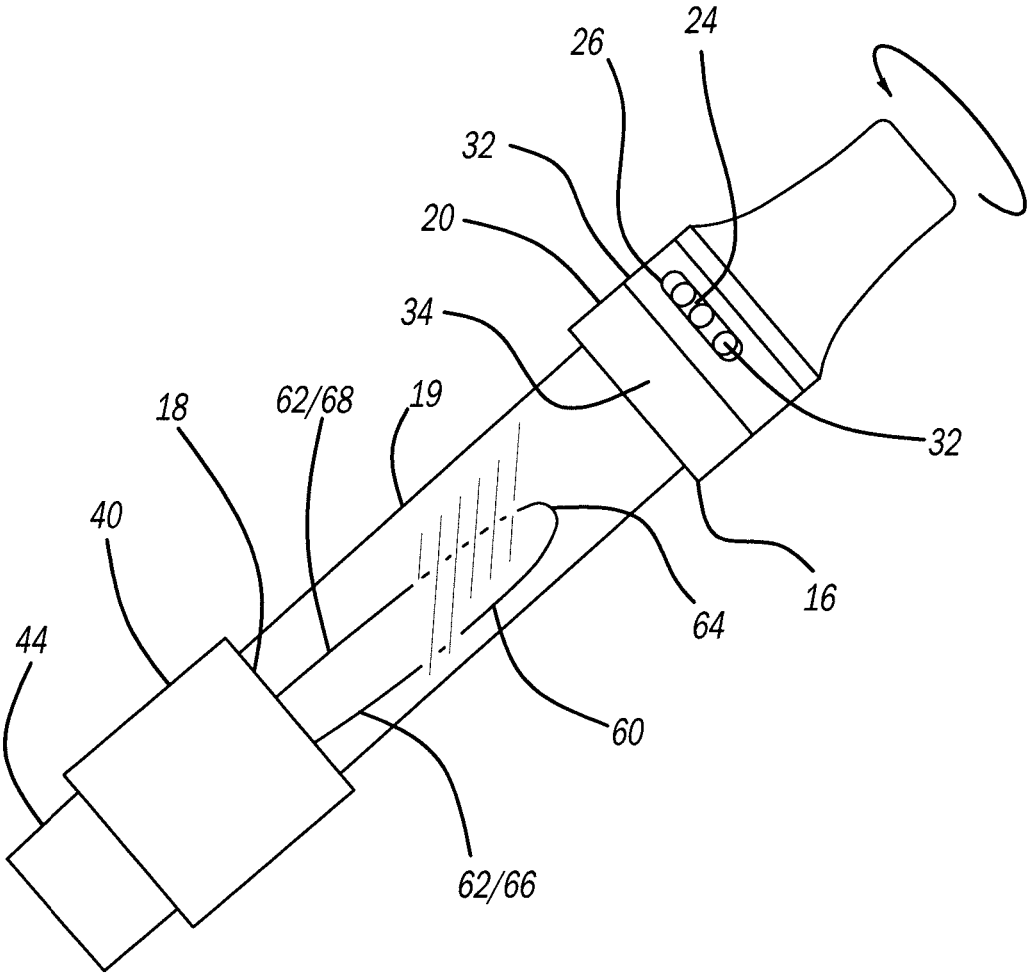
FIG. 6 is a side view of an exemplary consumption cartridge containing adjustable cooling, in accordance with the present invention.

Again, with reference to the Figures, and in yet another exemplary embodiment, a cartridge consumption system 10 contains a cartridge 12 and a first housing 14 having a first open end 16 and a second end 18, wherein the cartridge 12 is adapted to contain a consumable material 17 therein. The first open end 16 is adapted to draw effluent from said housing 14 therethrough, by a mouthpiece 30, for example. A heating element 60 extends within the housing 14 along the length of the housing 14 from the second end 18 towards the first end 16, the heating element 60 adapted to directly contact and heat consumable material 17 in thermal communication therewith (see FIG. 4). A power source 70 such as a battery may be in electronic communication with the heating element 60, wherein the heating element 60 is preferably a metallic mesh substrate.

In another exemplary embodiment, a cartridge consumption system 10 contains a cartridge 12, and a tubular housing 14 having a first open end 16, a second end 18, and an annular wall 19, the first open end 16 adapted to draw air and tubular effluent therefrom. A metallic mesh heating element 60 extends within and along the length of the tubular housing 14, and electronically communicates with a power source 70, for directly heating a thixotropic, solid, and/or liquid consumable material 17 in direct contact with the heating element 60. The power source 70 such as a battery is remotely connected to the housing 14 for heating the metallic mesh heating element 60 contained within the housing 14, and for also heating the annular wall 19 of the first housing 14. As described below, the metallic mesh heating element 60 may be a folded, crimped metal mesh substrate, wherein the metallic mesh heating element 60 may have a mid-portion with about half of a thickness of a first prong or end portion 66 and a second prong or end portion 68 of the metallic mesh heating element 60. The heating cup 46 is insulated from the power source 70, wherein the first end portion 66 thermally and/or electrically communicates with the power source 70, and, the second end portion 68 thermally and/or electrically communicates with the heat cup.

In yet another exemplary embodiment, a cartridge consumption system 10 may contain a housing 14 containing a first open end 16 and a second end 18, wherein the housing 14 is adapted to contain a consumable material 17 therein (e.g. the consumable material 17 is inserted or loaded into the housing 14 for consumption). A perforated collar 20 may be fixed to and extend from the first open end 16, wherein the perforated collar 20 contains one or more collar orifices 26 for adjustably controlling a flow of cooling air into and through the perforated collar 20. In conjunction therewith, a perforated mouthpiece 30 is fixed to and rotatably communicates with the perforated collar 20 for opening or occluding the one or more collar orifices 26, and for drawing effluent from said housing and if desired, drawing air through said one or more orifices. To that end, one or more mouthpiece apertures or orifices 32 are provided in the mouthpiece 30 to laterally align with the corresponding one or more collar orifices 26, as the mouthpiece 30 is rotated. In this way, the flow of air through the collar orifices 26 and through the mouthpiece orifices 32 may be modulated to occlude or open the resultant passages as the mouthpiece and collar orifice(s) 26 are either aligned, partially aligned, or non-aligned as the mouthpiece is rotated. A heating assembly 38 fixed to the second end of the housing 18, contains a heating cup 46 and a power source 70 for increasing the temperature of the heating cup 46 (as described below). A heating element 60 is fixed to and adapted to electrically and thermally communicate with the heating cup 46 upon actuation of the heating cup 46, whereby, in accordance with the present invention, the heating element 60 extends within the housing 14 and during operation of the system 10, directly contacts and heats consumable material 17 in thermal communication therewith.

Heating Element—Exemplary Method of Manufacture

In yet another aspect of the present invention, the heat element 60, or metallic mesh heating element 60, may be formed in a novel manner to thereby provide the enhanced heating of the present cartridge system 10.

1. In a first step, an exemplary conduction material such as stainless-steel mesh 316L having a 400-mesh size is selected. A mesh sample is cut to about 0.5 cm wide×5.0 cm long.
2. In a second step, the sample size is then longitudinally folded in half to result in a mesh sample size of about 0.25 cm wide×5.0 cm long, wherein the resultant length is about twenty times the width of the metal mesh substrate.
3. In a third step, the sample size is then for a second time longitudinally folded in half on the ends only (about ¼ to ⅓ of the length of the mesh or about 1.25 to 1.67 cm on each end) to result in a mesh sample size of about 0.125 cm wide on the first end and the second end of the mesh sample, having a length about 10 to 14 times the width of the metal mesh substrate. A middle portion of the mesh sample, about 1.67 to about 2.50 cm in length, is not folded a second time and therefore retains its width of about 0.25 cm.
4. In a fourth step, the mesh sample is pinched to form a first and second groove at the two junctions defined where the 0.125 cm width portions and 0.25 cm width portion meet. As such, two grooves are formed, a first groove formed at about one-third of the length of the mesh, and a second groove formed at about two-thirds of the length of the mesh, with reference to the first groove.
5. In a fifth step, the mesh sample is gripped or retained at the 0.25 cm width middle flattened portion, and at each groove, the mesh is torqued in the same arcuate direction, to achieve an approximate 90-degree displacement from the flattened 0.25 cm width portion.
6. In a sixth step, the mesh sample ends are brought together and the flattened 0.25 cm width portion is pinched to create a median crimp within the 0.25 cm width portion. As will be appreciated each first and second end of the mesh are respectively formed to create the first heating element end 62 containing the first prong 66 and the second prong 68, and, the second heating element end 64 is the less dense 0.25 cm width flattened and crimped portion of the heating element 60. It will be further appreciated that the less dense portion of the heat element 60 represented by the 0.25 cm width flattened portion heats up relatively quicker than the thicker ends sized at 0.125 cm wide, thereby providing a significant heating improvement as compared to known state-of-the-art vape cartridge systems.

Product by Process

Figure 8A:
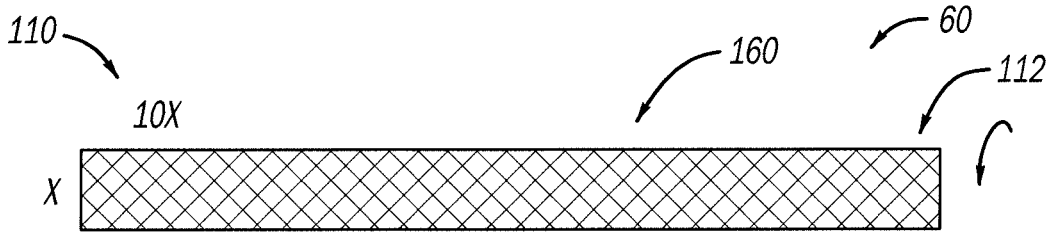
FIGS. 8A-8D are an illustration of a method of forming a heating element, in accordance with the present invention.
Figure 8B:
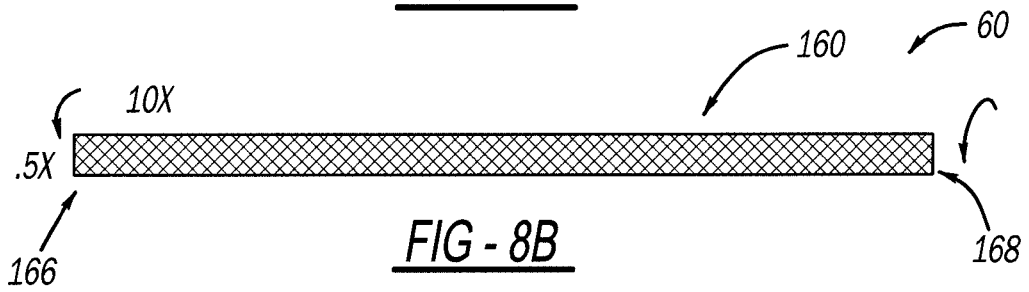
Figure 8C:
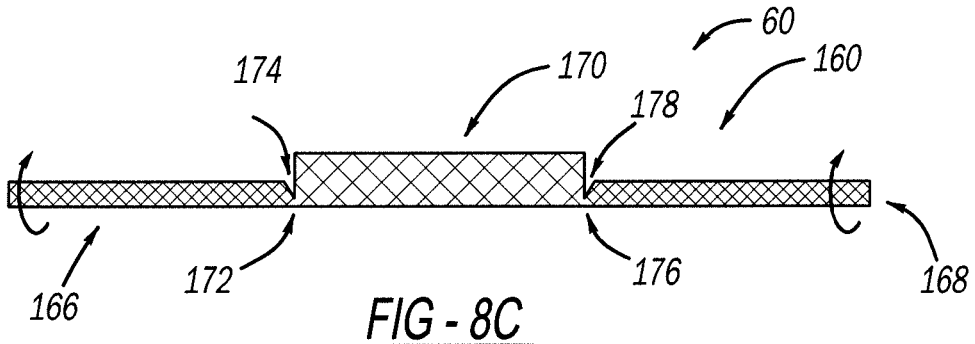
Figure 8D:
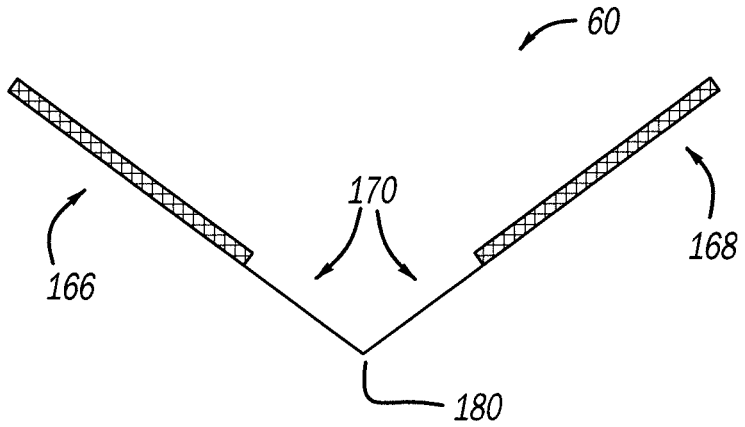

In yet another aspect of the invention, and with reference to FIGS. 8A-8D, the cartridge consumption system 10 may contain a metallic mesh heating element 60 formed from the method including the steps of:

(a) providing a metal mesh (e.g. stainless steel) substrate 160 with a length about ten times that of its width, the metal mesh substrate 160 having a first end 110 and a second end 112 (see FIG. 8A);
(b) longitudinally folding the metal mesh substrate 160 in half, to result in a length about twenty times that of the width of the metal mesh substrate 160 (see FIG. 8B);
(c) from said first end 112, longitudinally folding about one-fourth to one-third of the length of the metal mesh substrate 160 in half, thereby resulting in a first end portion 166 of the metal mesh substrate 160 (see FIG. 8C);
(d) from said second end, longitudinally folding about one-fourth to one-third of the length of the metal mesh substrate 160 in half, thereby resulting in a second end portion 168 of the metal mesh substrate, each end portion having a length about 10 to 14 times the width, and a mid-portion 170 having a length 6 to 7 times the width of the mid-portion 170 (see FIG. 8C);
(e) pinching the junction 172 between the first end portion 166 and the mid-portion 170 to form a first groove 174 in the metal mesh substrate 160 (see FIG. 8C);
(f) pinching the junction 176 between the second end portion 168 and the mid-portion 170 to form a second groove 178 in the metal mesh substrate 160, the first and second grooves oriented in the same direction (see FIG. 8C);
(g) rotating the first end portion 166 of the metal mesh substrate 160 at the first groove 174, to achieve a first angular displacement from the mid-portion 170 (see FIG. 8C); and
(h) rotating the second end portion 168 of the metal mesh substrate 160 at the second groove 178, to achieve a second angular displacement from the mid-portion 170, wherein at each groove, the respective first and second end portions 166, 168 are torqued or rotated in the same arcuate direction (see FIG. 8C);
(i) pinching the flat mid-portion 170 to create a median crimp 180 therein, and thereby creating a first and second prong 166, 168, and a resilient metallic mesh heating element 60 (see FIG. 8D).

In a preferred embodiment, the first and second angular displacements may be about 90 degrees, and each of the first and second end portions may be about one-third of the total length of the metal mesh substrate.

It will be understood that the foregoing descriptions of various embodiments of the present invention are for illustrative purposes only. As such, the various structural and operational features herein disclosed are susceptible to a number of modifications, none of which departs from the spirit and scope of the present invention as described above and as shown in the drawings. Accordingly, the embodiments and descriptions are meant to exemplify, but not limit, the invention as presented in the appended claims.

What is claimed is:

1. A cartridge consumption system comprising:

a cartridge comprising a housing containing a first open end and a second end, said housing adapted to contain a consumable material therein;

a perforated collar fixed to and extending from said first open end, said perforated collar containing one or more collar orifices for adjustably controlling a flow of air into said perforated collar;

a perforated mouthpiece fixed to and rotatably communicating with said perforated collar for opening or occluding said one or more collar orifices, and for drawing effluent from said housing and if desired, drawing air through said one or more collar orifices;

a heating assembly comprising a heating cup and a power source for actuating said heating cup, said heating assembly fixed to said second end, and said housing in physical and thermal conductive communication with said heating cup; and a heating element electrically communicating with said power source and fixed to and adapted to thermally communicate with said heating cup, said heating element extending from said heating cup and into said housing and adapted to physically contact and heat consumable material therein.

2. The cartridge consumption system of claim 1 wherein said perforated mouthpiece comprises one or more mouthpiece apertures that may be aligned with said one or more collar orifices.

3. A cartridge consumption system comprising:

a cartridge comprising a housing containing a first open end and a second end, said housing adapted to contain a consumable material therein and said first open end adapted to draw effluent from said housing therethrough;

a heating assembly comprising an electronically conductive heating cup and a power source for actuating said heating cup, said heating assembly fixed to said second end, and said housing in physical and thermal conductive communication with said heating cup; and a heating element extending within said housing from said second end towards said first end, said heating element adapted to directly contact and heat consumable material in thermal communication therewith.

4. The cartridge consumption system of claim 3 wherein said heating element is formed from the method comprising the steps of:

providing a metal mesh (stainless steel) substrate with a length about ten times that of its width, said metal mesh substrate having a first end and a second end;

longitudinally folding the metal mesh substrate in half, to result in a length about twenty times that of the width of the metal mesh substrate;

from said first end, longitudinally folding about one-fourth to one-third of the length of the metal mesh substrate in half, thereby resulting in a first end portion of the metal mesh substrate;

from said second end, longitudinally folding about one-fourth to one-third of the length of the metal mesh substrate in half, thereby resulting in a second end portion of the metal mesh substrate, each end portion having a length about 10 to 14 times the width, and a mid-portion having a length 6 to 7 times the width of the mid-portion;

pinching the junction between the first end portion and the mid-portion to form a first groove in the metal mesh substrate;

pinching the junction between the second end portion and the mid-portion to form a second groove in the metal mesh substrate, the first and second grooves oriented in the same direction;

rotating the first end portion of the metal mesh substrate at the first groove, to achieve a first angular displacement from the mid-portion; and rotating the second end portion of the metal mesh substrate at the second groove, to achieve a second angular displacement from the mid-portion, wherein at each groove, the respective first and second end portions are torqued or rotated in the same arcuate direction;

pinching the mid-portion to create a median crimp therein, thereby creating a first and second prong, and a resilient metallic mesh heating element.

5. The cartridge consumption system of claim 4 wherein each of said first and second angular displacements are about 90 degrees.

6. The cartridge consumption system of claim 4 wherein each of said first and second end portions are about one-third of the total length of the metal mesh substrate.

7. The cartridge consumption system of claim 5 further comprising:

a heating assembly comprising a housing and a heating cup contained therein, said heating assembly fixed to said second end; and a power source for actuating said heating cup, said heating cup adapted to electrically and thermally communicate with said heating element.

8. The cartridge consumption system of claim 7 wherein said power source is a battery.

9. The cartridge consumption system of claim 8 wherein said heating assembly further comprises:

a base located at a distal end of the heating assembly, for electronic communication with said battery;

an insulating annular seal adjacent an inner wall of said heating cup;

a battery-contact endpiece contained within said insulating annular seal and heating cup, said battery-contact endpiece in electronic communication with said base; and a first conductive prong and a second conductive prong integral to said heating element, said first and second prongs extending through said second end, and said first prong electronically communicating with said battery-contact endpiece, and, said second prong electronically communicating with said heating cup.

10. The cartridge consumption system of claim 3 further comprising:

a battery in electronic communication with said heating element, wherein said heating element is a metal mesh.

11. The cartridge consumption system of claim 3 wherein said first housing is tubular.

12. The cartridge consumption system of claim 3 wherein said consumable material may be in a thixotropic, solid, and/or liquid state.

13. A cartridge consumption system comprising:

a first section containing:

a housing containing a first open end, a second open end, and an outer wall, said housing adapted to contain a consumable material therein;

a perforated collar fixed to and extending from said first open end, said perforated collar containing one or more collar orifices for adjustably controlling a flow of air into said perforated collar;

a perforated mouthpiece containing one or more mouthpiece orifices, said perforated mouthpiece fixed to and rotatably communicating with said perforated collar for opening or occluding said one or more collar orifices as they are aligned on non-aligned with said one or more mouthpiece orifices, and for drawing effluent from said housing and if desired, drawing air through said one or more collar orifices;

a heating element containing a first prong and a second prong, said heating element extending from said second end and adapted to directly contact and heat consumable material in said housing in thermal communication therewith; and, a second section comprising:

a power source;

a heating assembly comprising a heating cup in electric communication with said power source, and in physical and thermally conductive communication with said housing;

a base located at a distal end of the heating assembly, for electronic communication with said power source;

an insulating annular seal adjacent an inner wall of said heating cup for insulating said heat cup from said battery-contact endpiece; and a battery-contact endpiece contained within said insulating annular seal and heating cup, said battery-contact endpiece in electronic communication with said base; wherein said first and second prongs extend through said second end, and said first prong electronically communicates with said battery-contact endpiece, and, said second prong electronically communicates with said heating cup.

14. A cartridge consumption system comprising:

a tubular housing having a first open end, a second end, and an annular wall, said first open end adapted to draw air and tubular effluent therefrom;

an electrically conductive heating cup in physical and thermodynamic communication with said housing;

a power source connected to said heating cup; and a metallic mesh heating element extending within said tubular housing and electronically communicating with said power source, for directly heating a thixotropic, solid, and/or liquid consumable material in direct contact therewith.

15. The cartridge consumption system of claim 14 wherein said metallic mesh heating element is a folded, crimped metal mesh substrate, said metallic mesh heating element having a mid-portion with about half of a thickness of a first end portion and a second end portion of the metallic mesh heating element.

16. The cartridge consumption system of claim 15 further comprising a heat cup insulated from said power source, wherein said first end portion electronically communicates with said power source, and, said second end portion thermally communicates with said heat cup.

17. The cartridge consumption system of claim 15 wherein said mid-portion has at least twice the area of either the first or second end portion.

18. The cartridge consumption system of claim 15 further comprising:

a battery as said power source;

a heating assembly fixed to said second end, said heating assembly containing a base adapted to be in electrical contact with said battery;

a heating cup containing an annular wall and contained within said heating assembly, said tubular housing fixed about said annular wall in thermal communication with said heating cup; and a battery-contact endpiece contained within said heating cup and in electrical communication with said base and said battery, but insulated from said heating cup, wherein said first end portion electronically communicates with said battery-contact endpiece, and, said second end portion electronically or thermally communicates with said heating cup, whereby said metallic mesh heating element thereby heats the tubular housing.

19. The cartridge consumption system of claim 18 wherein an outer portion of said base threadedly receives a battery thereon.

* * * * *